US006981336B2

(12) United States Patent
Nagae et al.

(10) Patent No.: US 6,981,336 B2
(45) Date of Patent: Jan. 3, 2006

(54) WASHING/DRYING MACHINE

(75) Inventors: Etsushi Nagae, Gunma (JP); Hiroshi Mukaiyama, Gunma (JP); Koji Ono, Gunma (JP); Masaya Tadano, Gunma (JP); Tetsuya Masuda, Gunma (JP); Kazuyoshi Tomochika, Gunma (JP); Takahiro Nakamura, Gunma (JP); Masakatsu Morishige, Shiga (JP); Harumi Takeuchi, Shiga (JP); Kiyokazu Fujikawa, Shiga (JP); Tamotsu Kawamura, Shiga (JP); Motohiko Kosano, Gunma (JP); Shinichi Akiyama, Shiga (JP); Nobuo Koumoto, Shiga (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 10/948,797

(22) Filed: Sep. 24, 2004

(65) Prior Publication Data

US 2005/0072022 A1 Apr. 7, 2005

(30) Foreign Application Priority Data

Sep. 24, 2003 (JP) ..... 2003-331348

(51) Int. Cl.
*F26B 21/06* (2006.01)
*F26B 11/02* (2006.01)

(52) U.S. Cl. ..... 34/77; 34/73; 34/86; 34/596

(58) Field of Classification Search ..... 34/78, 34/86, 596, 134, 607, 73, 74, 75, 76, 77
See application file for complete search history.

(56) References Cited

U.S. PATENT DOCUMENTS

| | | | | |
|---|---|---|---|---|
| 4,907,418 | A * | 3/1990 | DeFazio | 62/238.6 |
| 5,146,693 | A * | 9/1992 | Dottor et al. | 34/77 |
| 6,032,494 | A * | 3/2000 | Tanigawa et al. | 68/12.06 |
| 6,904,703 | B2 * | 6/2005 | Naganawa et al. | 34/596 |

FOREIGN PATENT DOCUMENTS

| | | |
|---|---|---|
| JP | 11-099299 | 4/1999 |

* cited by examiner

*Primary Examiner*—Kenneth Rinehart
(74) *Attorney, Agent, or Firm*—McDermott Will & Emery LLP

(57) ABSTRACT

There is disclosed a washing/drying machine having a purpose of shortening a time required for a washing operation and improving an operation efficiency, and comprising: an inner drum in which things to be washed are accommodated and in which a washing operation of the things to be washed and a drying operation after end of the washing operation are performed; a water supply passage for supplying water into the inner drum and a drainage passage for discharging the water from the inner drum in the washing operation; a refrigerant circuit in which a compressor, a gas cooler, an expansion valve, an evaporator and the like are successively connected to one another in an annular form via a piping and in which carbon dioxide is used as a refrigerant; and a blower for blowing air which has exchanged heat with the gas cooler into the inner drum to allow the air passed through the inner drum to exchange the heat with the evaporator in the drying operation.

4 Claims, 1 Drawing Sheet

WASHING/DRYING MACHINE

BACKGROUND OF THE INVENTION

1. Field of the Invention

The present invention relates to a washing/drying machine including an accommodating chamber in which things to be washed are accommodated and in which washing and drying of the things to be washed are executed.

2. Description of the Related Art

In recent years, there has been provided a washing/drying machine for automatically performing washing to drying in an accommodating chamber in which things to be washed are accommodated. The washing/drying machine performs a washing operation having a plurality of different steps such as washing, rinsing, and spin-drying steps, and a drying operation for drying the things to be washed spin-dried in the steps.

Here, in the drying operation, an electric heater or a gas combustion heater has heretofore been used as a heat source. After heating outside air by the electric heater or the gas combustion heater to obtain high-temperature air, the air is blown into the accommodating chamber in which the things to be washed are accommodated, and the things to be washed in the accommodating chamber are dried. Moreover, the high-temperature air in the accommodating chamber, by which the things to be washed have been dried, is exhausted to the outside.

However, when the drying operation is performed using the electric heater, the gas combustion heater or the like, moisture-containing outside air at a low temperature outside the accommodating chamber is used in the high-temperature air blown into the accommodating chamber, and therefore a long time is required until the things to be washed dry. Therefore, there have been problems that energy consumption for drying things to be dried increases and energy costs such as electricity and gas cost rise remarkably.

To solve the problem, a washing/drying machine has also been developed in which a heating pump constituted of a compressor, a heating coil, an expansion valve, and a cooling coil and capable of circulating a heat exchange medium is used, the things to be washed are dried by the high-temperature air heated by the heating coil, and moisture evaporated from the washed things is coagulated and discarded by the cooling coil (see, for example, Japanese Patent Application Laid-Open No. 11-99299).

By the use of the heating pump, it can be expected that a time required for drying the things to be washed is shortened and energy efficiency is raised, but there has been an earnest demand for improvement of a relative efficiency of an operation including the washing operation in the washing/drying machine which executes both the washing operation and the drying operation in the accommodating chamber.

SUMMARY OF THE INVENTION

According to the present invention, there is provided a washing/drying machine comprising: an accommodating chamber in which things to be washed are accommodated and in which a washing operation of the things to be washed and a drying operation after end of the washing operation are performed; water supply means for supplying water into the accommodating chamber and draining means for discharging the water from the accommodating chamber in the washing operation; a refrigerant circuit in which a compressor, a gas cooler, a decompression device, an evaporator and the like are successively connected to one another in an annular form via a piping and in which carbon dioxide is used as a refrigerant; and blower means for blowing air which has exchanged heat with the gas cooler into the accommodating chamber to allow the air passed through the accommodating chamber to exchange the heat with the evaporator in the drying operation, wherein the water supplied into the accommodating chamber by the water supply means in the washing operation is heated by the refrigerant on a high pressure side of the refrigerant circuit.

According to the present invention, electric energy and operation time required for drying the things to be washed in the drying operation are reduced, and the drying operation with good efficiency can be realized.

Especially, since the water supplied into the accommodating chamber by the water supply means in the washing operation is heated by the refrigerant on the high pressure side of the refrigerant circuit, temperature of the water supplied into the accommodating chamber in the washing operation is raised, and water solubility of a washing agent can be enhanced. Accordingly, since washing performance is improved, a time required for the washing operation can also be reduced, and it is generally possible to remarkably improve an operation efficiency.

Moreover, the above-described invention comprises: a drainage reservoir section in which the water discharged from the accommodating chamber by the draining means is once stored, and the refrigerant on a low pressure side of the refrigerant circuit is evaporated to absorb the heat from the water stored in the drainage reservoir section in the washing operation.

According to the present invention, in addition to the above-described invention, the heat is drawn from the water discharged from the accommodating chamber and once stored in the drainage reservoir section, and it is possible to heat the water supplied into the accommodating chamber with good efficiency. Moreover, since a heat absorbing structure can be integrated in the drainage reservoir section, the washing/drying machine can be miniaturized.

Moreover, according to the present invention, in the above-described invention, the refrigerant on the low pressure side of the refrigerant circuit is evaporated to absorb the heat from the outside air in the washing operation.

According to the present invention, in addition to the above-described invention, the heat is drawn from the outside air, and the water supplied into the accommodating chamber can be heated with good efficiency.

Furthermore, according to the present invention, the above-described invention further comprises: an auxiliary evaporator for absorbing the heat from the water or the outside air in the drainage reservoir section; channel control means for controlling whether to pass the refrigerant passed through the decompression device into the evaporator or the auxiliary evaporator; and control means for controlling the compressor, the blower means, and the channel control means, and the control means operates the compressor at the time of water supply by the water supply means, and the refrigerant is passed through the auxiliary evaporator by the channel control means.

According to the present invention, in addition to the above-described inventions, an operation time of the compressor at the time of the washing operation can be minimized, and energy efficiency can further be improved.

DETAILED DESCRIPTION OF THE PREFERRED EMBODIMENT

Figure 1:
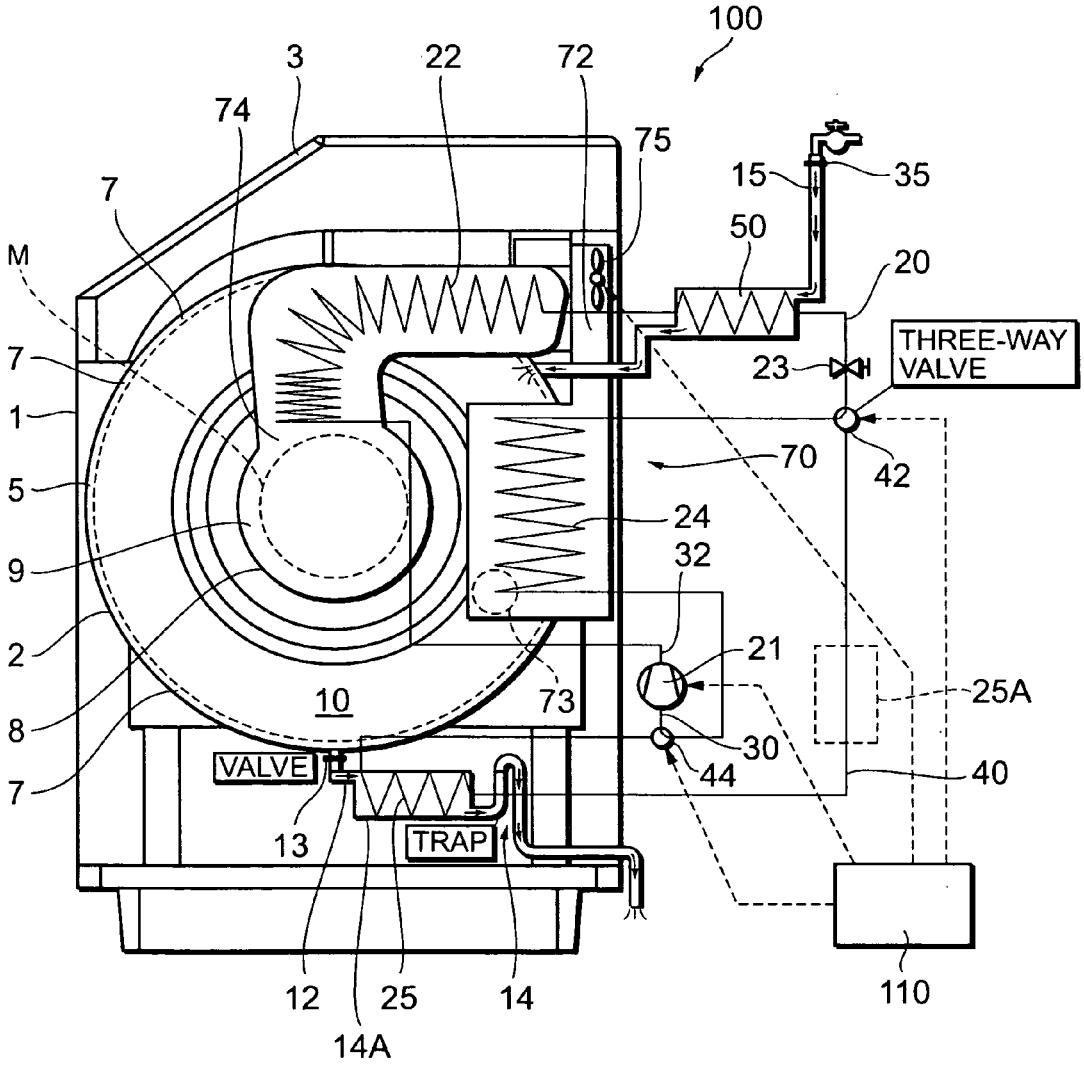
FIG. 1 is an inner constitution diagram of a washing/drying machine according to an embodiment of the present invention.

According to the present invention, to solve the technical problems, there is provided a washing/drying machine capable of shortening a time required for the washing operation and improving an operation efficiency. An embodiment of the present invention will be described hereinafter with reference to the drawings.

FIG. 1 shows an inner constitution diagram of a washing/drying machine 100 viewed from a side surface thereof, which is one embodiment of the present invention. The washing/drying machine 100 is used for washing and drying. The washing/drying machine 100 is used for washing and drying things to be washed such as clothes. An opening/closing door 3 for inserting/removing the things to be washed is attached to a middle portion of the upper surface of a main body 1 forming an outer structure, and an operation panel (not shown) in which various operation switches and a display portion are disposed is disposed on the upper surface of the main body 1 beside the opening/closing door 3.

A cylindrical resin outer drum 2 capable of storing water is disposed in the main body 1, and the outer drum 2 is disposed with respect to an axis of a cylinder which is a right/left direction. Moreover, a cylindrical stainless steel inner drum 5 which serves both as a washing tank and a spin-drying tank is disposed inside the outer drum 2. The inside of the inner drum 5 is constituted as an accommodating chamber 10 in which the things to be washed are accommodated, and is also disposed with respect to the axis of the cylinder which is the right/left direction. The axis is connected to a shaft 8 of a driving motor M attached to a side wall (inner side of FIG. 1) of the main body 1, and the inner drum is held rotatably in the outer drum 2 centering on the shaft 8.

A watertight opening/closing lid (not shown) for inserting/removing the things to be washed is disposed corresponding to the opening/closing door 3 in an upper part of the outer drum 2. A large number of through-holes 7 . . . via which air and water can circulate are formed in a whole peripheral wall of the inner drum 5. A stopping position of the inner drum 5 is defined, and an opening/closing lid (not shown) for inserting/removing the things to be washed is disposed in a position (upper surface) of the inner drum corresponding to the opening/closing lid of the outer drum 2 at the time of stopping.

The driving motor M is a motor for rotating the inner drum 5 centering on the shaft 8 in the right/left horizontal direction in a washing operation and a drying operation after end of the washing operation. The driving motor M is attached to one end of the shaft 8, and is controlled by a control device 110 which is control means described later in such a manner as to rotate the inner drum 5 at a low speed at the time of the drying operation as compared with the washing operation.

A hollow portion 9 whose inner portion is formed to be hollow is formed in the other end of the shaft 8, and an air circulation path 72 described later is connected into the inner drum 5 via the hollow portion 9.

On the other hand, a water supply passage 15 which is water supply means for supplying water into the inner drum 5 is disposed in the upper part of the main body 1, and one end of the water supply passage 15 is connected to a water source of tap water or the like via a water supply valve 35 also constituting the water supply means. The water supply valve 35 is controlled to open/close by the control device 110. The other end of the water supply passage 15 is connected to the outer drum 2 to communicate with the inside of the drum, and is constituted in such a manner that water (tap water) is supplied to the accommodating chamber 10 in the inner drum 5 disposed in the outer drum 2 from the water source, when the water supply valve 35 is opened by the control device 110.

It is to be noted that a heat exchanger 50 described later for heating the water supplied to the accommodating chamber 10 as described above is disposed in the water supply passage 15 in a heat exchanging manner.

Moreover, a draining passage 12 which is draining means for discharging the water of the accommodating chamber 10 in the inner drum 5 is disposed in a lower part of the main body 1, and one end of the draining passage 12 communicates with a bottommost portion of the outer drum 2 via a draining valve 13 (also constituting the draining means) which is controlled to open/close by the control device 110. The other end of the draining passage 12 is derived to the outside of the washing/drying machine 100, and extends to a drain ditch or the like.

Here, a U trap 14 for sealing the inside of the draining passage 12 by the water discharged from the accommodating chamber 10 is constituted in the draining passage 12, and a drainage reservoir section 16 whose passage is expanded/opened is formed before the U trap 14 (on a draining valve 13 side). When the draining valve 13 is opened by the control device 110, the water (drainage) from the accommodating chamber 10 is one stored in the drainage reservoir section 16, and thereafter overflows out of the U trap 14. Moreover, when the draining valve 13 is closed, the draining passage 12 is sealed with the water by the U trap 14 in a state in which the water is stored in the drainage reservoir section 16. Furthermore, an auxiliary evaporator 25 described later is disposed in the drainage reservoir section 16 in a heat exchanging manner.

On the other hand, in the washing/drying machine 100, a machine chamber 70 is constituted laterally from a lower side and/or a rear side of the outer drum 2 in the main body 1, and the above-described air circulation path 72 is constituted in the machine chamber 70.

An inlet 73 is formed in one end of the air circulation path 72, and an evaporator 24 of a refrigerant circuit 20 described later is disposed in the air circulation path 72 in the vicinity of the inlet 73 of the air circulation path 72. Moreover, the inlet 73 of the air circulation path 72 communicates with a rear part in the outer drum 2. An outlet 74 is formed in the other end of the air circulation path 72, and a gas cooler 22 of the refrigerant circuit 20, described later, is disposed in the air circulation path 72 in the vicinity of the outlet 74. The outlet 74 of the air circulation path 72 opens in the hollow portion 9 formed in the other end of the shaft 8.

Moreover, a blower 75 which is blower means is disposed in the air circulation path 72. The blower supplies air into the accommodating chamber 10 in the inner drum 5 from the outlet 74 of the air circulation path 72 via the hollow portion 9 of the shaft 8. That is, in the washing/drying machine 100, at the time of the drying operation, the air in the inner drum 5 is circulated in the air circulation path 72 by the blower 75 to thereby heat the air by heat exchange with the gas cooler 22 disposed on an outlet 74 side of the air circulation path 72, and thereafter the air is discharged into the accommodating chamber 10 in the inner drum 5. Moreover, the air which has circulated in the accommodating chamber 10 to dry the things to be washed is drawn in the air circulation path 72 from the inlet 73, exchanges the heat with the evaporator 24 disposed on an inlet 73 side, and is cooled and dehumidified. Thereafter, the air is drawn in the blower 75 again, supplied to the gas cooler 22, and discharged into the accommodating chamber 10.

Next, in FIG. 1, reference numeral 20 denotes the refrigerant circuit, and the refrigerant circuit 20 is constituted by successively connecting a compressor 21, the gas cooler 22, an expansion valve 23 which is a decompression device, the evaporator 24 and the like to one another in an annular form via a piping. A predetermined amount of carbon dioxide ($CO_2$) is sealed as a refrigerant in the refrigerant circuit 20. Here, the compressor 21 for use in the present embodiment is a rotary compressor of an inner intermediate pressure type multistage compression system, and an electromotive element, and a first rotary compression element (first stage) and a second rotary compression element (second stage) driven by the electromotive element are disposed in an airtight container (not shown).

Moreover, a low-pressure refrigerant is introduced into the first rotary compression element of the compressor 21 from a refrigerant guide pipe 30, and a high-temperature/pressure refrigerant compressed by the second rotary compression element is discharged to the outside of the compressor 21 from a refrigerant discharge pipe 32.

The refrigerant discharge pipe 32 of the compressor 21 is connected to the inlet of the gas cooler 22 for heating the air, which is disposed on the outlet 74 side of the air circulation path 72. A piping extending out of the gas cooler 22 extends to the expansion valve 23 through the heat exchanger 50. The outlet of the expansion valve 23 is connected to the inlet of the evaporator 24 disposed on the inlet 73 side via a three-way valve 42 constituting channel control means, the outlet of the evaporator 24 is connected to the refrigerant guide pipe 30 via another three-way valve 44 also constituting the channel control means, and the evaporator reaches the compressor 21. The operation of the compressor 21, the expansion valve 23, and the three-way valves 42, 44 are controlled by the control device 110.

The heat exchanger 50 is disposed in such a manner as to exchange the heat with the refrigerant (high-temperature/pressure refrigerant) on the high pressure side of the refrigerant circuit 20 and the water supplied into the outer drum 2 from a supply water source via the water supply passage 15. The water passed through the water supply passage 15 exchanges the heat with the heat exchanger 50, and is heated by the refrigerant on the high pressure side.

On the other hand, a bypass circuit 40 which bypasses the evaporator 24 is formed in the refrigerant circuit 20, and the bypass circuit 40 is connected to the auxiliary evaporator 25 disposed in the drainage reservoir section 16 of the draining passage 12 as described above. Opposite ends of the bypass circuit 40 are connected to the three-way valves 42, 44. Moreover, the control device 110 operates the compressor 21 at the time of the water supply by the water supply passage 15, and passes the refrigerant through the auxiliary evaporator 25 by the three-way valves 42, 44.

It is to be noted that the above-described control device 110 is control means for controlling the washing/drying machine 100, and controls operating of the driving motor M, opening/closing of the water supply valve 35 of the water supply passage 15, opening/closing of the draining valve 13 of the draining passage 12, operating of the compressor 21, throttle adjusting of the expansion valve 23, an air amount of the blower 75, and switching of the three-way valves 42, 44. Furthermore, the control device 110 also controls the temperature of the air passed through the gas cooler 22 in order to prevent the things to be washed accommodated in the inner drum 5 from being discolored or damaged.

Next, an operation of the washing/drying machine 100 constituted as described above will be described. The things to be washed and a predetermined amount of washing agent corresponding to an amount of the things to be washed are thrown into the accommodating chamber 10 in the inner drum 5. When a power switch and a start switch are operated among the above-described operation switches, the control device 110 starts a washing operation. In the washing operation, the control device 110 switches the three-way valves 42, 44 in such a manner that the refrigerant flows through the auxiliary evaporator 25 of the bypass circuit 40. Furthermore, the control device 110 opens the water supply valve 35 of the water supply passage 15 to open the water supply passage 15. Accordingly, water is supplied into the accommodating chamber 10 of the inner drum 5 in the outer drum 2 from the water source. It is to be noted that the draining valve 13 of the draining passage 12 is closed at this time.

Moreover, the control device 110 starts the electromotive element of the accommodating chamber 10 simultaneously with the opening of the water supply valve 35. Accordingly, the refrigerant ($CO_2$) is drawn in and compressed by the first rotary compression element of the compressor 21. The refrigerant which has been compressed by the first rotary compression element to obtain an intermediate pressure is discharged into the airtight container, the refrigerant discharged into the airtight container is drawn in the second rotary compression element, subjected to a second stage of compression to constitute a high-temperature/pressure refrigerant gas, and discharged to the outside from the refrigerant discharge pipe 32.

The refrigerant gas discharged from the refrigerant discharge pipe 32 flows into the heat exchanger 50 via the gas cooler 22. During the washing operation, the blower 75 is not operated. Therefore, the refrigerant flows into the heat exchanger 50 substantially without releasing heat in the gas cooler. Here, the refrigerant compressed by the compressor 21 and flowing to the heat exchanger 50 from the gas cooler 22 on the high pressure side of the refrigerant circuit 20 does not condense, and the operation is performed in a supercritical state. Moreover, the temperature of the refrigerant flowing into the heat exchanger 50 rises at about +130° C., and the high-temperature/pressure refrigerant gas exchanges the heat with the water passed through the water supply passage 15, releases the heat, and flows out of the heat exchanger 50. On the other hand, the water which has taken the heat from the refrigerant on the high pressure side in the heat exchanger 50 turns to warm water, and supplied into the accommodating chamber 10 in which the things to be washed are accommodated via the outer drum 2.

When the water passed through the water supply passage 15 is heated in the heat exchanger 50 in this manner, the warm water can be supplied to the accommodating chamber 10 in the inner drum 5 from the outer drum 2 through the through-holes 7. That is, when the temperature of the water supplied to the accommodating chamber 10 is raised in the washing operation, water solubility of the washing agent can be enhanced.

Accordingly, the washing agent is prevented from being undissolved, dirt on the things to be washed can be effectively removed, and enhancement of the washing performance and reduction of the washing time can be achieved.

It is to be noted that the operation of the compressor 21 is controlled by the control device 110 in such a manner that the water supplied from the water supply passage 15 is heated, for example, at about +30° C. to +40° C. in the heat exchanger 50.

On the other hand, the refrigerant which has flown out of the heat exchanger 50 reaches the expansion valve 23. Here, the refrigerant is decompressed and liquefied, and flows into the auxiliary evaporator 25 disposed in the drainage reservoir section 16 of the draining passage 12 via the three-way valve 42. The refrigerant which has entered the auxiliary evaporator 25 absorbs the heat from the water (drainage) stored in the drainage reservoir section 16 and evaporates. That is, the refrigerant circuit 20 functions as a heating pump which pumps up the heat from the water stored in the drainage reservoir section 16 of the draining passage 12 by the refrigerant in the auxiliary evaporator 25, and conveys the heat to the heat exchanger 50 to heat the water supplied to the accommodating chamber 10.

Accordingly, waste heat can be recovered from the water discharged into the drainage reservoir section 16 from the accommodating chamber 10, and an energy efficiency can be improved. The water can be efficiency heated by the heat exchanger 50.

It is to be noted that the control device 110 controls a valve open degree of the expansion valve 23 and the operation of the compressor 21 in such a manner as to prevent the water stored in the drainage reservoir section 16 before the U trap 14 from being frozen by the cooling by the auxiliary evaporator 25. For example, the temperature of the water is set at +3° C. to +5° C.

Thereafter, the refrigerant is drawn in the first rotary compression element of the compressor 21 from the refrigerant guide pipe 30 via the three-way valve 44, and this cycle is repeated.

When a predetermined amount of warm water is accumulated in the accommodating chamber 10 in the inner drum 5, the control device 110 closes the water supply valve 35 to close the water supply passage 15. Accordingly, water supply from the water source is stopped. The control device 110 stops the operation of the compressor 21 synchronously with the stopping of the water supply.

Next, the driving motor M formed in the side surface of the main body 1 is energized/started by the control device 110 to rotate the shaft 8, accordingly the inner drum 5 attached to the shaft 8 starts rotating in the outer drum 2, and a washing process of the washing operation is started.

When a predetermined time elapses from the start of the washing process, the driving motor M is stopped by the control device 110, and the draining valve 13 of the draining passage 12 is opened to discharge the water (washing water) in the accommodating chamber 10 (i.e., in the outer drum 2) of the inner drum 5 via the U trap 14 as described above.

Moreover, when the water in the accommodating chamber 10 of the inner drum 5 is discharged, the control device 110 operates the driving motor M again to spin-dry the things to be washed. After performing the spin-drying for a predetermined time, the control device 110 closes the draining valve 13 of the draining passage 12. Accordingly, the warm water supplied to the inner drum 5 is stored in the drainage reservoir section 16 of the draining passage 12.

Next, the control device 110 shifts to a rinsing process, and opens the water supply valve 35 of the water supply passage 15 to open the water supply passage 15. Accordingly, the water is supplied to the accommodating chamber 10 in the inner drum 5 from the water source again. The control device 110 restarts the accommodating chamber 10 synchronously with the opening of the water supply valve 35, and heats the supplied water by the heat exchanger 50 in the same manner as described above.

Accordingly, the warm water heated by the heat exchanger 50 is supplied into the accommodating chamber 10 also in the rinsing process in the same manner as in the washing process. The heat drawn from the drainage reservoir section 16 of the draining passage 12 is used in the heat exchanger 50.

On the other hand, when a predetermined amount of water is supplied to the accommodating chamber 10 in the inner drum 5, the control device 110 closes the water supply valve 35 to close the water supply passage 15. Accordingly, the water supply from the water source is stopped. The control device 110 stops the operation of the compressor 21.

Moreover, after a rotation operation of the driving motor M is repeated for a predetermined time to perform the rinsing, the control device 110 stops the driving motor M, and opens the draining valve 13 of the draining passage 12 to discharge the rinsing water in the accommodating chamber 10 to the draining passage 12. When the rinsing water in the accommodating chamber 10 is discharged, the control device 110 operates the driving motor M again, rotates the inner drum 5 in the same manner as described above, and shifts to a spin-drying process to spin-dry the things to be washed.

Since the warm water heated in the heat exchanger 50 is supplied to the inner drum 5 also in the rinsing process in this manner, the washing agent attached to the things to be washed is dissolved and can be effectively dropped. Accordingly, a rinsing capability is enhanced, and a rinsing time can be shortened.

Moreover, since the compressor 21 is operated only during the water supply, the operation time of the compressor 21 can be minimized, the washing and rinsing time is also shortened, and the energy efficiency can further be improved as a whole.

Furthermore, since the heated warm water is supplied to the inner drum 5, the temperature of the accommodating chamber 10 is raised before the drying operation. Therefore, the raising of the temperature at the startup can be assisted from when the compressor 21 is started at the time of the drying operation until the gas cooler 22 is warmed at a predetermined high temperature. Accordingly, the reduction of the drying time and the enhancement of the operation efficiency of the washing/drying machine 100 can be achieved.

Moreover, after performing the spin-drying process for a predetermined time, the control device 110 closes the draining valve 13. The control device 110 switches the three-way valves 42, 44 in such a manner that the refrigerant in the refrigerant circuit 20 flows into the evaporator 24, starts the compressor 21, and starts the operation of the blower 75. Moreover, the driving motor M rotates the inner drum 5, and the process shifts to a drying operation. In the drying operation, a high-temperature/pressure refrigerant gas discharged from the compressor 21 radiates the heat in the gas cooler 22 and heat exchanger 50, and thereafter the pressure of the gas is reduced by the expansion valve 23. Next, the refrigerant flows into the evaporator 24 to absorb the heat from a periphery thereof, evaporates, and is drawn in a first rotation compression element of the compressor 21 from the refrigerant discharge pipe 32. The refrigerant is circulated in this manner.

Moreover, by the operation of the blower 75, the air heated by the heat radiation of the high-temperature/pressure refrigerant in the gas cooler 22 at a high temperature flows out into the hollow portion 9 from the outlet 74 of the air circulation path 72, and is blown into the accommodating chamber 10 of the inner drum 5.

The heated air (at +85° C. to +95° C. at this time) blown into the accommodating chamber 10 warms the washed things accommodated in the inner drum 5 (accommodating chamber 10) to evaporate moisture, and the washed things are dried. The moisture-containing air (air temperature at about +60° C.) which has dried the washed things flows through the accommodating chamber 10, flows out of the inner drum 5 via through-holes 7, is drawn into the air circulation path 72 from the inlet 73, and flows through the evaporator 24 disposed therein. The temperature of the evaporator 24 drops at about +3° C. by the evaporation of the refrigerant. Therefore, the moisture in the air coagulates on the surface of the evaporator 24 in the process of the passage through the evaporator 24, and drops as water droplets. The water droplets which have dropped are discharged to an external drain ditch and the like from the draining passage 12 via a drain pipe (not shown).

Moreover, the dried air (temperature drops at +20° C. to +30° C.) from which the moisture has been removed by the evaporator 24 is drawn in the blower 75, and blown on the outlet 74 side of the air circulation path 72. Since the gas cooler 22 is disposed on the outlet 74 side of the air circulation path 72 as described above, the dried air is heated again in the gas cooler 22, and thereafter blown into the accommodating chamber 10 in the inner drum 5 via the hollow portion 9 of the shaft 8. The moisture is taken from the washed things in the inner drum 5, and they are dried. This circulation is repeated.

When the drying operation is performed for a predetermined time in the control device 110, the washed things in the accommodating chamber 10 in the inner drum 5 are completely dried.

It is to be noted that in the above-described embodiment, the auxiliary evaporator 25 is disposed in the drainage reservoir section 16 before the U trap 14 of the draining passage 12, and the heat is absorbed from the discharged water (drainage) to evaporate the water. However, the present invention is not limited to this embodiment. The auxiliary evaporator may be disposed in a position (auxiliary evaporator 25A shown by a broken line in FIG. 1) capable of exchanging the heat with the outside air, and absorb the heat from the outside air for the evaporation. Furthermore, the auxiliary evaporator 25A may be disposed together with the auxiliary evaporator 25 of the drainage reservoir section 16 before the U trap 14 of the draining passage 12 in such a manner that the auxiliary evaporator 25 absorbs the heat from the drainage and the auxiliary evaporator 25A absorbs the heat from the outside air. In this case, the energy efficiency can further be enhanced. Moreover, even when the drainage is not stored in the drainage reservoir section 16 before the U trap 14 in an initial operation after installing the washing/drying machine 100, the auxiliary evaporator 25A can draw the heat from the outside air.

Moreover, in the present embodiment, the control device 110 turns on/off the compressor 21 synchronously with the opening/closing of the water supply valve 35. However, the present invention is not limited to this embodiment. The compressor 21 may be started before opening the water supply valve 35. Accordingly, the temperature of the heat exchanger 50 can be raised beforehand at the time of the start of the water supply. Conversely, the compressor 21 may be stopped before closing the water supply valve 35, and thereafter the water may be heated by remaining heat of the heat exchanger 50. Accordingly, further reduction of power consumption can be achieved.

Furthermore, the rotary compressor of the inner intermediate pressure type multistage (two-stage) compression system including the first and second rotary compression elements is used in the compressor 21 of the present embodiment, but the compressor 21 usable in the present invention is not limited to this rotary compressor.

What is claimed is:

1. A washing/drying machine comprising:

an accommodating chamber in which things to be washed are accommodated and in which a washing operation of the things to be washed and a drying operation after end of the washing operation are performed;

water supply means for supplying water into the accommodating chamber and draining means for discharging the water from the accommodating chamber in the washing operation;

a refrigerant circuit in which a compressor, a gas cooler, a decompression device, an evaporator are successively connected to one another in an annular form via a piping and in which carbon dioxide is used as a refrigerant; and blower means for blowing air which has exchanged heat with the gas cooler into the accommodating chamber to allow the air passed through the accommodating chamber to exchange the heat with the evaporator in the drying operation, wherein the water supplied into the accommodating chamber by the water supply means in the washing operation is heated by the refrigerant on a high pressure side of the refrigerant circuit.

2. The washing/drying machine according to claim 1, further comprising:

a drainage reservoir section in which the water discharged from the accommodating chamber by the draining means is once stored, wherein the refrigerant on a low pressure side of the refrigerant circuit is evaporated to absorb the heat from the water stored in the drainage reservoir section in the washing operation.

3. The washing/drying machine according to claim 1, wherein the refrigerant on the low pressure side of the refrigerant circuit is evaporated to absorb the heat from the outside air in the washing operation.

4. The washing/drying machine according to claim 2 or 3, further comprising:

an auxiliary evaporator for absorbing the heat from the water or the outside air in the drainage reservoir section;

channel control means for controlling whether to pass the refrigerant passed through the decompression device into the evaporator or the auxiliary evaporator; and control means for controlling the compressor, the blower means, and the channel control means, wherein the control means operates the compressor at the time of water supply by the water supply means, and the refrigerant is passed through the auxiliary evaporator by the channel control means.

* * * * *